US006545594B1

(12) United States Patent
Knight et al.

(10) Patent No.: US 6,545,594 B1
(45) Date of Patent: Apr. 8, 2003

(54) AUDIO CLOSURE

(75) Inventors: John D. Knight, Marietta, GA (US); Joseph M. Ladina, Marietta, GA (US); George E. Selecman, Marblehead, MA (US); Thomas P. Hambleton, Nahant, MA (US); Douglas J. Ely, North Andover, MA (US); Daniela Homza-Stark, Andover, MA (US); Dean M. Pichon, Arlington, MA (US); David Nedder, Attleboro, MA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/578,877

(22) Filed: May 25, 2000

(51) Int. Cl.[7] ..... G08B 3/10

(52) U.S. Cl. ..... 340/384.7; 340/384.1; 206/217

(58) Field of Search ..... 340/384.1, 384.6, 340/384.7, 692, 815.69, 540, 686.4, 391.1; 206/217, 457; 220/257, 258, 500, 522; 368/10; 215/220

(56) References Cited

U.S. PATENT DOCUMENTS

| | | | | | |
|---|---|---|---|---|---|
| 3,804,663 | A | | 4/1974 | Clark | 427/542 |
| 3,938,120 | A | | 2/1976 | O'Connell | 340/546 |
| 4,121,835 | A | | 10/1978 | Garabedian | 369/68 |
| 4,164,284 | A | | 8/1979 | Witt et al. | 206/217 |
| 4,363,179 | A | | 12/1982 | Ruemer, Jr. et al. | 40/307 |
| 4,387,787 | A | * | 6/1983 | King | 181/155 |
| 4,398,491 | A | | 8/1983 | Fridl et al. | 116/67 R |
| 4,504,153 | A | * | 3/1985 | Schollmeyer et al. | 340/309.4 |
| 4,611,262 | A | | 9/1986 | Galloway et al. | 361/813 |
| 4,631,715 | A | | 12/1986 | Hoover | 369/68 |
| 4,646,350 | A | | 2/1987 | Batra | 340/540 |
| 4,756,222 | A | | 7/1988 | Armato | 84/600 |
| 4,791,741 | A | | 12/1988 | Kondo | 704/272 |
| 4,801,929 | A | | 1/1989 | Instance | 340/692 |
| 4,911,320 | A | | 3/1990 | Howes | 220/500 |
| 5,014,798 | A | * | 5/1991 | Glynn | 177/25.19 |
| 5,056,659 | A | | 10/1991 | Howes et al. | 206/217 |
| 5,056,681 | A | | 10/1991 | Howes | 220/522 |
| 5,076,433 | A | | 12/1991 | Howes | 206/459.5 |
| 5,099,232 | A | | 3/1992 | Howes | 340/815.69 |
| 5,130,696 | A | | 7/1992 | Liebman | 340/540 |
| 5,283,567 | A | | 2/1994 | Howes | 340/815.69 |
| 5,439,103 | A | * | 8/1995 | Howes | 206/217 |
| 5,443,767 | A | | 8/1995 | Cahill | 264/37.31 |
| 5,458,274 | A | | 10/1995 | Maietta | 222/39 |
| 5,464,092 | A | | 11/1995 | Seeley | 340/384.7 |
| 5,489,893 | A | | 2/1996 | Jo et al. | 340/686.4 |
| 5,500,636 | A | | 3/1996 | Mitchell | 340/328 |
| 5,524,788 | A | | 6/1996 | Plester | 220/522 |
| 5,536,196 | A | | 7/1996 | Sternberg | 446/81 |
| 5,550,532 | A | * | 8/1996 | Marshall | 340/604 |
| 5,575,383 | A | | 11/1996 | Seeley | 340/384.7 |
| 5,625,347 | A | | 4/1997 | MacLean et al. | 340/568.1 |
| 5,813,563 | A | | 9/1998 | Boehm et al. | 220/522 |
| 6,042,004 | A | * | 3/2000 | Domiteaux et al. | 235/380 |
| 6,216,905 | B1 | * | 4/2001 | Mogard et al. | 220/257 |

FOREIGN PATENT DOCUMENTS

| | | |
|---|---|---|
| CA | 2106528 | 9/1993 |
| DE | 28 13 454 | 9/1977 |
| FR | 2 767 118 A | 12/1999 |
| FR | 2 782 984 A | 10/2000 |
| WO | WO 95/34481 | 12/1995 |

* cited by examiner

*Primary Examiner*—Van Trieu
(74) *Attorney, Agent, or Firm*—Sutherland Asbill & Brennan LLP

(57) ABSTRACT

A closure for a bottle. The closure includes an outer cap. An audio device and a triggering mechanism are positioned within the outer cap. A water block is positioned on the outer cap so as to prevent water from penetrating into the audio device.

99 Claims, 6 Drawing Sheets

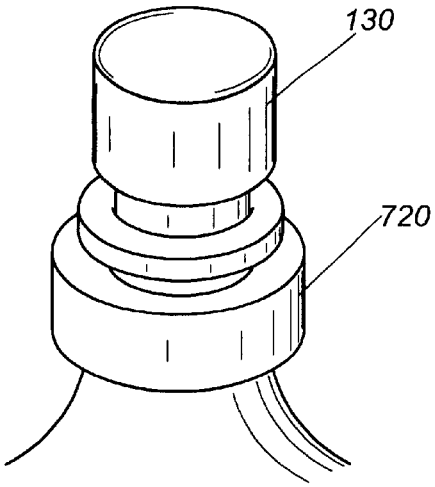
Fig. 8F
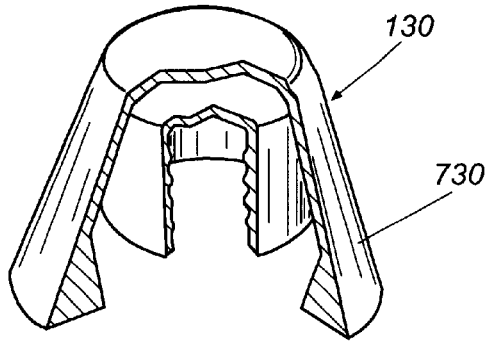
Fig. 8G
Fig. 9A
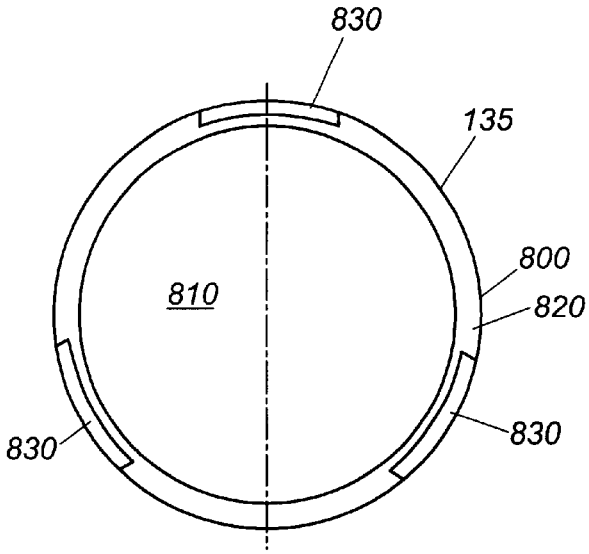
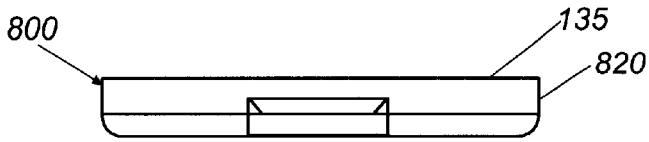
Fig. 9B

AUDIO CLOSURE

TECHNICAL FIELD

The present invention relates generally to bottle closures and more particularly relates to closures that emit an audible sound or message when removed from a bottle or otherwise activated.

BACKGROUND OF THE INVENTION

Various types of in-container promotions are known in the beverage and the container industries. Generally described, these devices provide different ways of delivering a promotion to a consumer. Specifically, known devices include several types of "under the cap" games, several types of "prize" cans, and several types of "talking" containers. For example, commonly owned U.S. Pat. No. 5,099,232, entitled "Prize Holding Container Assemblies", describes a message delivery system for a beverage container. The message delivery system can produce an audible message that the consumer has won a prize. U.S. Pat. No. 5,099,232 is incorporated herein by reference. Other types of sound producing devices also have been inserted within various types of beverage bottles and bottle closures.

Although the general concept of an audible bottle or an audible bottle closure may be known, these known devices may not be adequate for widespread consumer use or promotion. Specifically, these known devices may not be compatible with many types of promotions, with various types of governmental regulations, and even with modem, high-speed bottling procedures. For example, some audio devices intended to be placed under a bottle closure may be visible to the consumer unless a foil surrounds the bottleneck or unless the device is submerged in a dark liquid. Visibility of the device, however, may not be allowed under governmental gaming regulations, i.e., visual detection of the audio device is not permitted if only bottles with the device therein are "winners." Likewise, other types of governmental regulations may prohibit certain types of materials commonly used in audio devices from coming into direct contact with a consumable beverage, i.e., the audio device may not be submerged in or come into contact with the beverage.

Further, modem bottling practices require that the closure, and the audio device therein, must be relatively rugged and must be able to withstand contact with or submersion in water. It is not unusual for a beverage container to come in contact with water during the bottling process and then be submerged completely in ice water at a retail outlet or at home. The audible device within the closure must be able to sustain such submersion without a significant impact on sound quality. Likewise, the audio device must be able to withstand the temperature differential between, for example, hot ambient temperatures and an ice bath. The known closures and audio devices simply do not address adequately these practical issues.

What is needed, therefore, is a closure with an audio device for a beverage bottle that is indistinguishable from a normal closure, that meets all applicable governmental regulations, that will withstand the bottling process, that will withstand submersion within water, and that will withstand temperature differentials. Further, such an audio device should provide sufficiently clear sound regardless of conditions, be relatively easy to use, and be reasonably priced.

SUMMARY OF THE INVENTION

The present invention thus provides a closure for a bottle. The closure includes an outer cap. An audio device and a triggering mechanism are positioned within the outer cap. A water block is positioned on the outer cap so as to prevent water from penetrating into the audio device.

Specific embodiments of the present invention provide for the triggering mechanism to activate the audio device when the outer cap is removed from the bottle. The triggering mechanism also may activate the audio device on demand. The audio device includes a battery. The battery may have a number of battery cells. Among others, alkaline, silver oxide, zinc-air, or lithium cells may be used. The audio device also includes a circuit board with a voice chip. The voice chip may include instructions for reproducing a language-based message. The audio device also includes a speaker. The speaker may be a piezoelectric speaker, an electromagnetic speaker, or any other type of sound reproducing device. A hydrophobic membrane may cover the speaker. The outer cap may include a first end and a second end. The triggering mechanism and the audio device may be in the first end. The water block may have a top shield positioned adjacent to the audio device. The water block also may include a lateral surface. The lateral surface may include a number of apertures positioned therein so as to permit water to drain out of the water block.

The triggering mechanism also may include mechanical components, thermal sensors, environmental sensors, electronic components, magnetic components, optical sensors, acoustic sensors, and chemical sensors. Specifically, the triggering mechanism may include a double wall mechanism. The double wall mechanism may include a rigid cup surrounding a flexible enclosure. The rigid cup may be made from a substantially rigid thermoplastic such that the cup resists deformation. The thermoplastic may be polypropylene, polyethylene, PET, similar types of copolymers, or similar materials. The flexible enclosure may be a flexible thermoplastic material. The flexible thermoplastic material may be polypropylene, polyethylene, similar types of copolymers, or similar materials. The flexible enclosure may be a unitary element with the outer cap. The rigid cup prevents the flexible enclosure from deforming when the outer cap is positioned on the bottle. The flexible enclosure and the rigid cup separate when the outer cap is removed from the bottle such that the flexible enclosure may deform.

The double wall triggering mechanism also may include a contact switch. The contact switch is in a circuit with the audio device. The contact switch may have a number of arms and a platform. The arms are positioned within the flexible enclosure for movement therewith. The contact switch includes a first position when the outer cap is positioned on the bottle and a second position when the outer cap is removed from the bottle and the flexible enclosure deforms. Either the first position or the second position of the contact switch closes the circuit. The triggering mechanism may activate the audio device when the contact switch is in the second position.

The triggering mechanism also may include a pressure ratchet mechanism. The pressure ratchet mechanism may include an inner cup. The inner cup may be a unitary element with the outer cap. The inner cup may be made out of a flexible thermoplastic material. The inner cup also may include a bottom surface that is deformable under pressure. The inner cup also may include a pressure sensitive switch positioned adjacent to the bottom surface. The pressure sensitive switch is in a circuit with the audio device. The pressure sensitive switch includes a first position when the outer cap is positioned on the bottle and the bottom surface is deformed under pressure and a second position when the outer cap is removed from the bottle and the bottom surface relaxes. Either the first or the second position of the pressure sensitive switch closes the circuit. The triggering mechanism may activate the audio device when the pressure sensitive switch is in the second position.

The triggering mechanism also may include a push to play mechanism. The push to play mechanism includes an inner cup. The inner cup may be a unitary element with the outer cap. The inner cup may be a flexible thermoplastic material. The inner cup may have a bottom surface. The inner cup also may include a contact switch positioned adjacent to the bottom surface. The contact switch is in a circuit with the audio device. The triggering mechanism activates the audio device when the contact switch is pressed.

The triggering mechanism also may include a rotating undercap mechanism. The rotating undercap mechanism may include an inner cup. The inner cup may have a light transmissive layer. The inner cup has a first side and a second side. The first side has a first light transmissive level and the second side has a second light transmissive level. The rotating undercap mechanism may include a rotating undercap. The rotating cap is attached to the inner cup for rotation therewith. The rotating undercap may include a substantially light blocking layer. The rotating undercap may have an aperture positioned therein. The inner cup also has a light sensor positioned within the first side. The light sensor is in a circuit with the audio device. The light sensor has a first state when the outer cap is positioned on the bottle such that the aperture of the undercap is positioned on the second side of the inner cup and a second state when the outer cap is removed from the bottle and the aperture of the undercap is positioned on the first side of the inner cup. Either the first or the second state of the light sensor closes the circuit. The triggering mechanism activates the audio device when the light sensor is in the second state.

A further embodiment of the present invention provides for a closure for a bottle. The closure includes an outer cap. Positioned within the outer cap may be an audio device and a double wall triggering mechanism for activating the audio device. The double wall triggering mechanism may include a rigid cup surrounding a flexible enclosure. The rigid cup may be a substantially rigid thermoplastic such that the rigid cup resists deformation. The flexible enclosure may be a flexible thermoplastic material. The double wall triggering mechanism may include a contact switch. The contact switch may have a number of arms and a platform. The arms are positioned within the flexible enclosure for movement therewith. The contact switch includes a first position when the outer cap is positioned on the bottle and a second position when the outer cap is removed from the bottle. The double wall triggering mechanism activates the audio device when the contact switch is in the second position.

A further embodiment of the present invention provides for a closure for a bottle. The closure includes an outer cap. Positioned within the outer cap may be an audio device and a pressure ratchet triggering mechanism for activating the audio device. The pressure ratchet triggering mechanism includes a deformable inner cup. A switch may be positioned therein. The switch includes a first position when the outer cap is positioned on the bottle and the inner cup is deformed under pressure and a second position when the outer cap is removed from the bottle and the inner cup relaxes. The pressure ratchet triggering mechanism activates the audio device when the switch is in the second position.

A further embodiment of the present invention provides for a closure for a bottle. The closure includes an outer cap. Positioned within the outer cap may be an audio device and a push button trigger for activating the audio device. The push button trigger includes an inner cup with a switch positioned therein. The push button trigger activates the audio device when the switch is pressed.

A further embodiment of the present invention provides for a closure for a bottle. The closure includes an outer cap. Positioned within the outer cap may be an audio device and a light triggering mechanism for activating the audio device. The triggering mechanism includes an inner cup. The inner cup may have a light transmissive layer. The inner cup includes a first side and a second side. The first side has a first light transmissive level and the second side has a second light transmissive level. The light trigger mechanism also includes a rotating undercap. The rotating cap is attached to the inner cup for rotation therewith. The rotating undercap includes a substantially light blocking layer. The rotating undercap also includes an aperture positioned therein. The inner cup may have a light sensor positioned within the first side. The light sensor has a first state when the outer cap is positioned on the bottle such that the aperture of the undercap is positioned on the second side of the inner cup and a second state when the outer cap is removed from the bottle and the aperture of the undercap is positioned on the first side of the inner cup. The triggering mechanism activates the audio device when the light sensor is in the second state.

Other objects, features, and advantages of the present invention will become apparent upon review of the following detailed description of the preferred embodiments of the present invention, when taken in conjunction with the drawings and the appended claims.

BRIEF DESCRIPTION OF THE DRAWINGS

FIGS. 8A–8G show various embodiments of the outer cap.

FIG. 9A shows a top plan view of the water drain.

FIG. 9B shows a side plan view of the water drain.

DETAILED DESCRIPTION OF THE INVENTION

Figure 1:
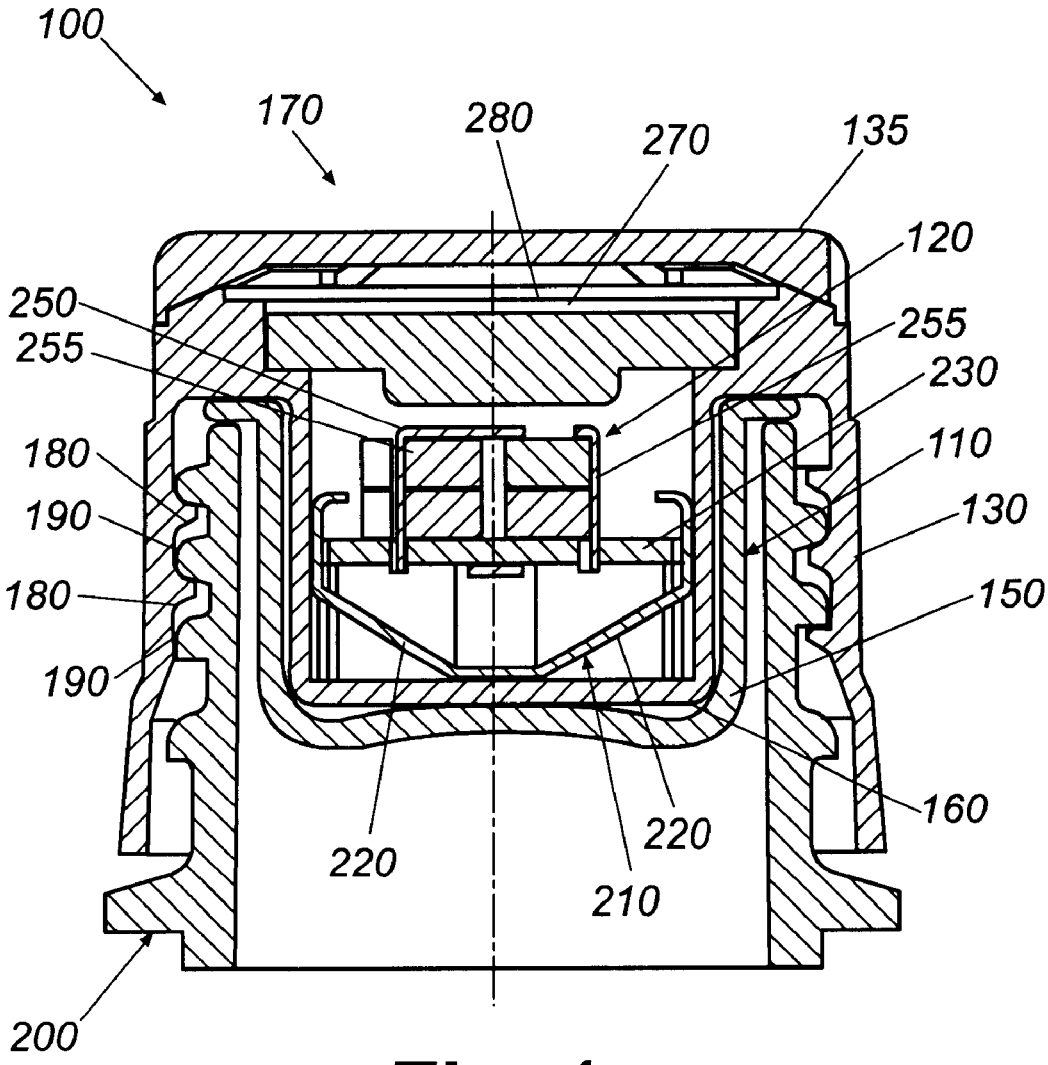
FIG. 1 is a side cross-sectional view of a closure of the present invention with the double wall triggering mechanism.
Figure 2:
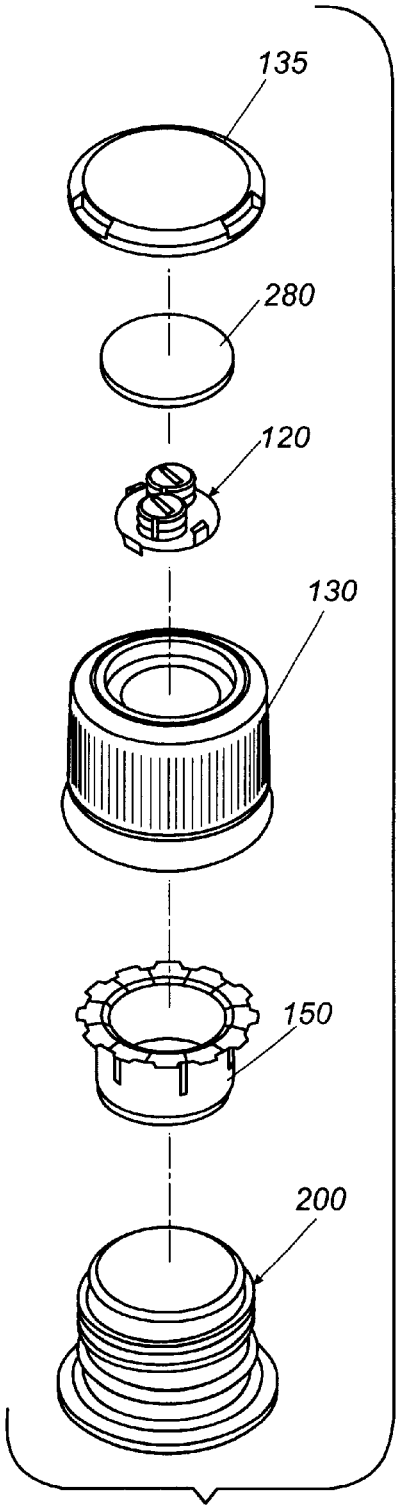
FIG. 2 is an exploded view of several of the elements of the closure of FIG. 1.

Referring now in more detail to the drawings, in which like numerals refer to like parts throughout the several views, FIGS. 1–2 show an audio bottle closure 100 of the present invention. The major components of the audio bottle closure 100 include a triggering mechanism 110, an audio device 120, an outer cap 130, and a water drain 135. Each of these components 110, 120, 130, 135 may have numerous embodiments that may be arranged in numerous combinations. Several of these embodiments and combinations will be described in detail below.

For example, FIGS. 1–4A and 4B show one embodiment of the triggering mechanism 110. In this case, a double wall design 140 of the triggering mechanism 110 is shown. The double wall design 140 may include a rigid cup 150 surrounding a flexible enclosure 160. The rigid cup 150 may be made from any substantially rigid thermoplastic such as polypropylene, polyethylene, PET, similar types of copolymers, or similar materials. The rigid cup 150 must be sufficiently rigid so as to resist deformation in a typical pressurized beverage container. In other words, the rigid cup 150 must resist deformation at ambient temperatures up to about fifty-five (55) pounds per square inch of pressure with about 2.5 to four (4) volumes of carbon dioxide in the case of a typical carbonated soft drink. The pressure may be even higher at elevated ambient temperature. The flexible enclosure 160 may be made from a more flexible thermoplastic material, such as polypropylene, polyethylene, similar types of copolymers, or similar materials. The flexible enclosure 160 is intended to be deformable. The flexible enclosure 160 may form a substantially hollow cup with an aperture 170 therein. As is shown, the flexible enclosure 160 may be formed as a unitary element with the outer cap 130. The flexible enclosure 160 and the outer cap 130 also may be fixedly attached to each other.

The outer cup 130 may be of conventional design and may include a plurality of threads 180 that mate with a plurality of threads 190 on a typical bottle 200 as is well known to those skilled in the art. The outer cup 130 may be made out of the same thermoplastic material as the flexible enclosure 160. The rigid cup 150 forms a seal with the bottle 200. Carbon dioxide gas that seeks to migrate out of the bottle 200 may escape via this seal as opposed to penetrating through the rigid cup 150 and the flexible enclosure 160 to the audio device 120.

The double wall design 140 of the triggering mechanism 110 also may include a contact switch 210. In this embodiment, the contact switch 210 may include a plurality of arms 220 that extend upward for engagement with a platform 230. The arms 220 may extend upwardly from a ledge 240 positioned or formed within the flexible enclosure 160. The arms 220 and the platform 230 of the contact switch 210 may be made of any substantially conductive material such as copper, silver-plated brass, thin sheet steel or similar materials.

Figure 3:
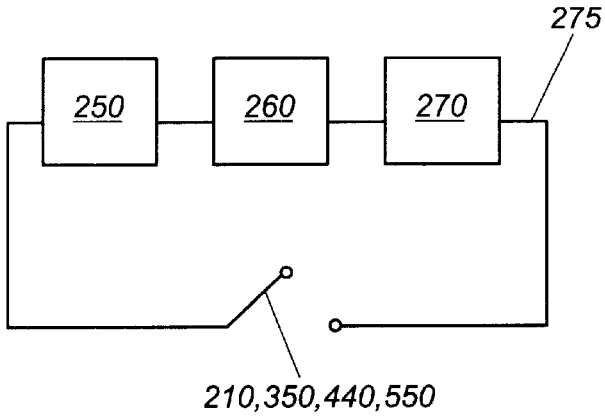
FIG. 3 is a schematic diagram of a circuit with the triggering mechanism and the audio device.

Positioned on the platform 230 is one embodiment of the audio device 120. The audio device 120 generally includes a battery 250, a circuit board 260, and a speaker 270. The battery 250 and the circuit board 260 may be positioned on or adjacent to the platform 230. The speaker 270 may be positioned within and substantially fill the top of the aperture 170. The speaker 270 preferably is mounted on the top of the closure 100 so as to face the consumer when the closure 100 is removed from the bottle 200. As is shown in FIG. 3, the battery 250, the circuit board 260, and the speaker 270 are connected in a circuit 275 with the contact switch 210. Generally described, the circuit 275 is complete when the contact switch 210 is triggered such that the battery 250 powers the circuit board 260 so as to produce sound through the speaker 270. Alternatively, the circuit 275 may be closed in the "as bottled" state, such that breaking the circuit activates the triggering mechanism 110. The battery 250, the circuit board 260, and the speaker 270, and any other audio device 120 components are preferably installed and connected via a lead-free solder.

As will be described in more detail below, the circuit board 260 is a conventional printed circuit board with a voice chip 265. The voice chip 265 is of conventional design. The voice chip 265 activates the speaker 270 with the appropriate predetermined message as is well known to those skilled in the art. A preferred voice chip 265 is a one-time programmable chip manufactured by Silicon Solutions, Inc and sold under the designation "IS22C012", a mask programmed chip manufactured by TUTAX, Co., Ltd. and sold under the designation "AMA071A-XX", and similar types of chips. The message may be the announcement of a prize, such as "you have won a pair of in-line skates", an advertisement for the product, or any other desired information. For example, if the closure 100 is used with a medicine bottle, the message may inform the user of the appropriate dosage. The message also may include music. Any desired message or sound may be produced.

The battery 250 may be any type of conventional power source. The selection of the battery 250 depends in part upon the type of speaker 270 used and whether the triggering mechanism 110 requires a stand-by current. The battery 250 may take the form of a plurality of battery cells 255 that may be used together. Conventional 1.5-volt alkaline, silver oxide, or zinc-air cells 255 may be used, among others. Further, 3-volt lithium batteries cells 255 also may be used. Other types of conventional power sources may be used.

The speaker 270 may be a conventional piezoelectric or an electromagnetic-type speaker. The speaker 270 should be selected for sound quality, energy drain, and ruggedness. A preferred electromagnetic speaker 270 is manufactured by Addax, Inc. and sold under the designation "ADX-8029A". The speaker 270 may be covered with a membrane 280 or other type of protective layer. The membrane 280 preferably keeps water, dust, and other particles away from the speaker 270. The membrane 280 may be made from a hydrophobic material such as certain types of Nylon, Mylar (polyester), Tyvek (high-density polyethylene), Goretex (expanded polytetrafluoroethylene) or by drilling these materials with, for example, a laser so as to produce very fine holes therein. A preferred laser-drilling method is described in commonly owned U.S. patent application Ser. No. 09/353,757, entitled "Vented Promotional Compartment," and incorporated herein.

Figure 4A:
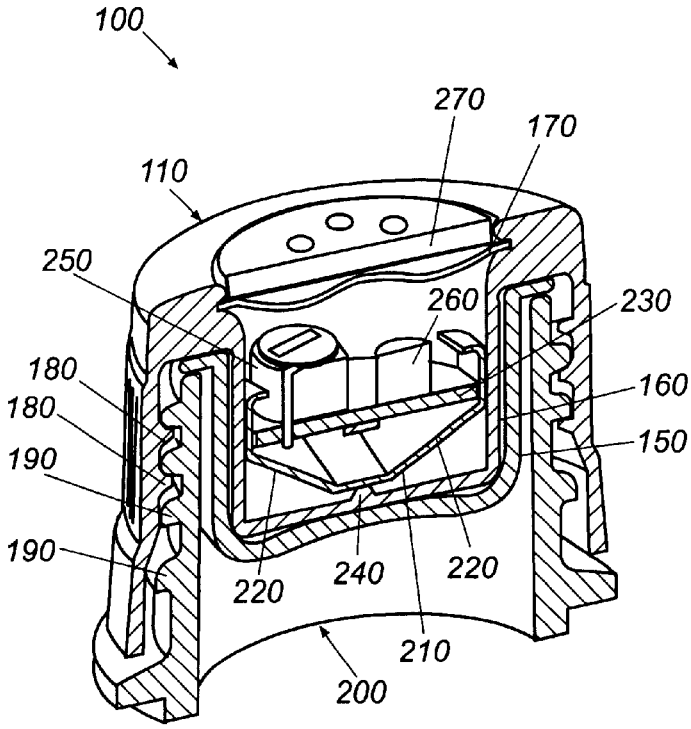
FIG. 4A is a perspective view of the double wall triggering mechanism in the "as bottled" state.
Figure 4B:
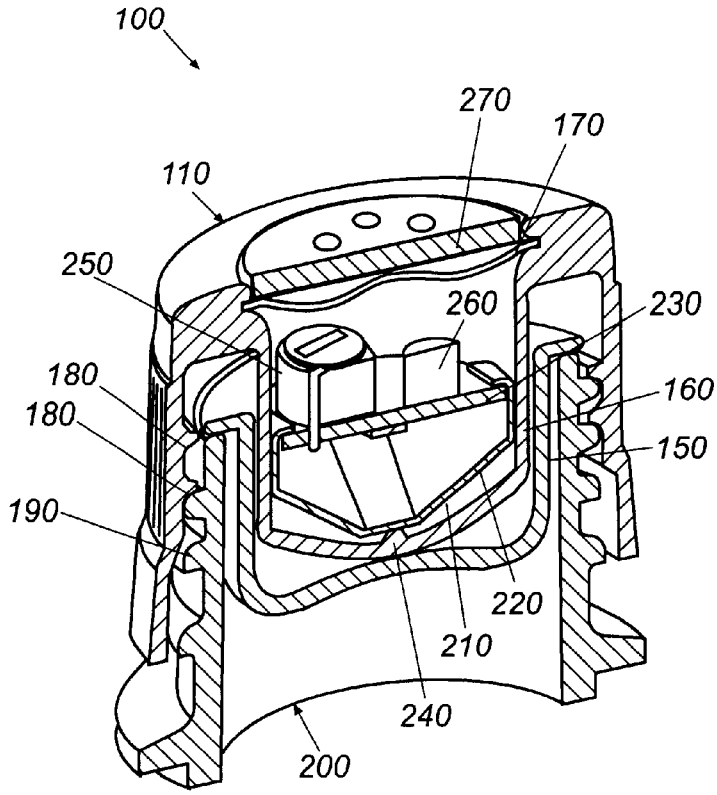
FIG. 4B is a perspective view of the double wall triggering mechanism in the "as opened" state.

As is shown in FIG. 4A, the rigid cup 150 prevents the flexible enclosure 160 from deforming in the "as bottled" positioned. As such, the arms 220 of the contact switch 210 do not contact the platform 230. The circuit 275 may be in an open condition when the arms 220 are not in contact with the platform 230. As is shown in FIG. 4B, the flexible enclosure 160 separates slightly from the rigid cup 150 as the outer cap 130 is removed. This separation allows room for the flexible enclosure 160 to deform by expanding back towards the rigid cup 150. This deformation causes the arms 220 of the contact switch 210 to come in contact with the platform 230. This contact completes the circuit 275 such that the battery 250 powers the circuit board 260 to produce sound through the speaker 270. Alternatively, the circuit 275 may be closed in the "as bottled" state, such that breaking the circuit activates the triggering mechanism 110.

As is performed by the double wall design 140, it is preferred for the triggering mechanism 110 to operate automatically upon the removal of the closure 100 from the bottle 200. Manually operated triggering mechanisms 110, however, also may be used. Further, the audio device 120 may be easily re-triggered by simply pressing the bottom of the rigid cup 150 after the closure 100 has been removed from the bottle 200. This pressing opens and then again closes the contact switch 210 and the circuit 275 so as to reactivate the audio device 120.

Figure 5:
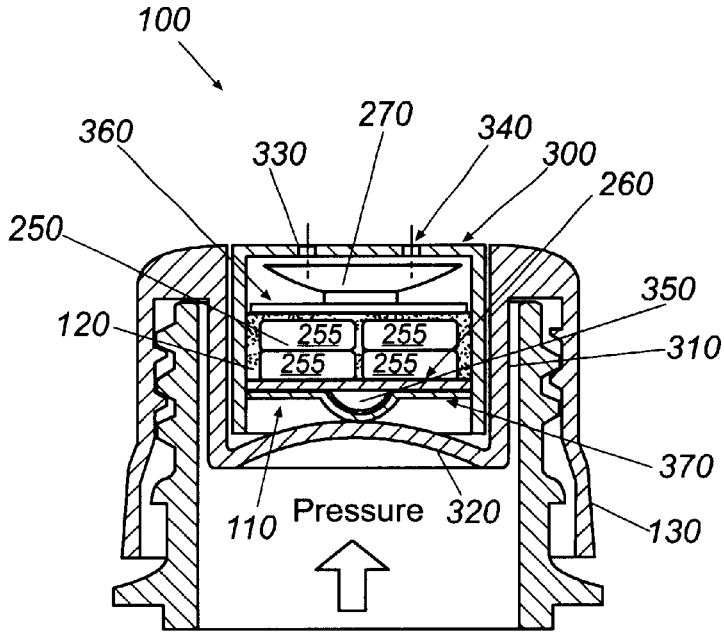
FIG. 5 is a side cross-sectional view of the pressure ratchet triggering mechanism.

FIG. 5 shows another embodiment of the triggering mechanism 110. In this case, a pressure ratchet design 300 is shown. The pressure ratchet design 300 includes an inner cup 310. The inner cup 310 may be formed as a unitary element with the outer cap 130. The inner cup 310 and the outer cap 130 also may be fixedly attached to each other. The inner cup 310 may be made from a flexible thermoplastic material such as polypropylene, polyethylene, similar types of copolymers, or similar materials. The inner cup 310 may be made from the same thermoplastic material as is the outer cap 130. The inner cup 310 may be deformed under pressure. Specifically, a bottom surface 320 of the inner cup 310 may dome inward under pressure. The pressure required to dome the bottom surface 320 is typically that found in a sealed carbonated soft drink container as described above. Positioned within the inner cup 310 is an audio housing 330. The audio housing 330 is largely in the shape of an inverted cup and may be made from the same thermoplastic material as the inner cup 310. The audio housing 330 may have a plurality of holes 340 in its top surface.

Positioned within the audio housing 330 may be a pressure sensitive switch 350. The pressure sensitive switch 350 may be a dome type switch as is shown, i.e., a shallow inverted cup; a membrane switch having, for example, two internal contact points forced together or apart by the pressure; or by a similar type of a contact switch. A preferred pressure sensitive switch 350 is manufactured by Snaptron, Inc. and sold under the designation "P22450". The pressure sensitive switch 350 is positioned adjacent to the bottom surface 320 of the inner cup 310 for contact therewith.

The pressure sensitive switch 350 also may be in the circuit 275 with the audio device 120. The audio device 120 also is positioned within the audio housing 330. The audio device 120 may have the same or similar components as those described above in FIGS. 4A and 4B. Specifically, the pressure sensitive switch 350 may be positioned adjacent to the battery 250, the circuit board 260, and the speaker 270. The speaker 270 may be positioned near the holes 340 of the audio housing 330. Various types of membranes 280 may be used herein to protect the audio device 120. A cushioning layer 360 may support the speaker 270. The cushioning layer 360 may be a thin layer of a closed cell foam. A membrane 370 also may be used to protect the pressure sensitive switch 350 from the internal gases. The membrane 370 may be made from polypropylene, polyethylene, similar types of copolymers, or similar materials.

When the pressure ratchet design 310 of the triggering mechanism 110 is in the "as bottled" position, the pressure within the bottle 200 causes the bottom surface 320 of the inner cup 310 to dome upward and contact the pressure sensitive switch 350. This positioning of the bottom surface 320 keeps the pressure sensitive switch 350 in the closed position. When in the closed position, the pressure sensitive switch 350 leaves the circuit 275 with the battery 250, the circuit board 260, and the speaker 270 in the open position. When the closure 100 is removed from the bottle 200, the pressure is released such that the bottom surface 320 is no longer deformed. The pressure sensitive switch 350 therefore closes the circuit 275 such that the battery 250 energizes the circuit board 260 and sound is produced through the speaker 270. Alternatively, the release of the pressure may cause the pressure sensitive switch 350 to close. Further, the circuit 275 may be closed in the "as bottled" state, such that breaking the circuit activates the audio device 120.

Figure 6:
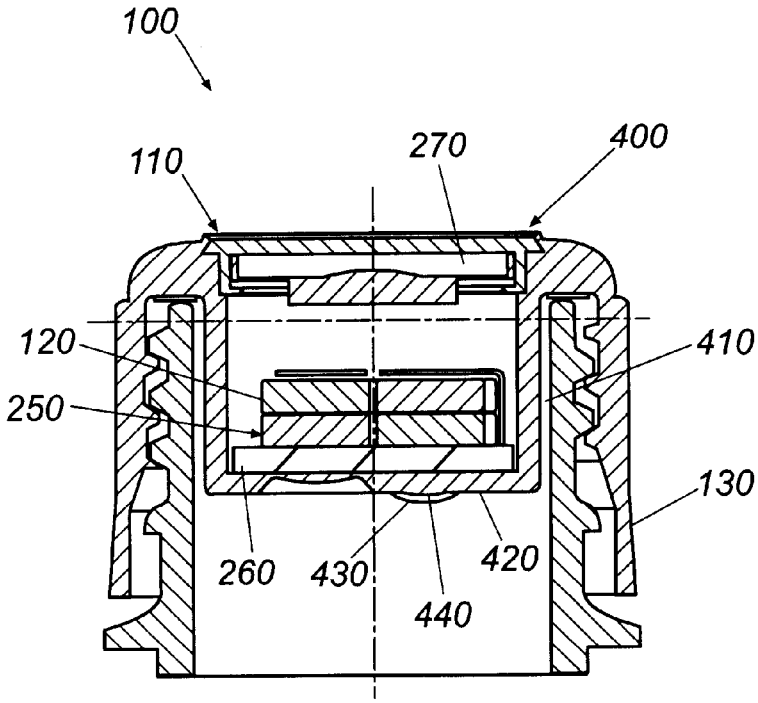
FIG. 6 is a side cross-sectional view of the push to play triggering mechanism.

FIG. 6 shows a further embodiment of the triggering mechanism 110. This embodiment shows a push-to-play design 400. The push-to-play design 410 also incorporates an inner cup 410. The inner cup 410 may be formed as a unitary element with the outer cap 130. The inner cup 410 and the outer cap 130 also may be fixedly attached. The inner cup 410 may be made from a flexible thermoplastic material such as polypropylene, polyethylene, similar types of copolymers, or similar materials. The inner cup 410 may be made from the same thermoplastic material as is the outer cap 130.

A bottom surface 420 of the inner cup 410 may have a raised button portion 430. Positioned within the bottom surface 420 of the inner cup 410 may be a contact switch 440. The contact switch 440 may be any type of conventional touch switch. The contact switch 440 also may be in the circuit 275 with the audio device 120. The audio device 120 may have the same or similar components as those described above. Specifically, the contact switch 440 may be positioned adjacent to the battery 250, the circuit board 260, and the speaker 270.

In use, the user presses the button portion 430 of the inner cup 410. This causes the contact switch 440 to complete the circuit 275 with the battery 250, the circuit board 260, and the speaker 270. The circuit 275 causes the circuit board 260 to produce sound through the speaker 270. The speaker 270 may be re-triggered by simply pressing the button portion 430 of the inner cup 410.

Figure 7:
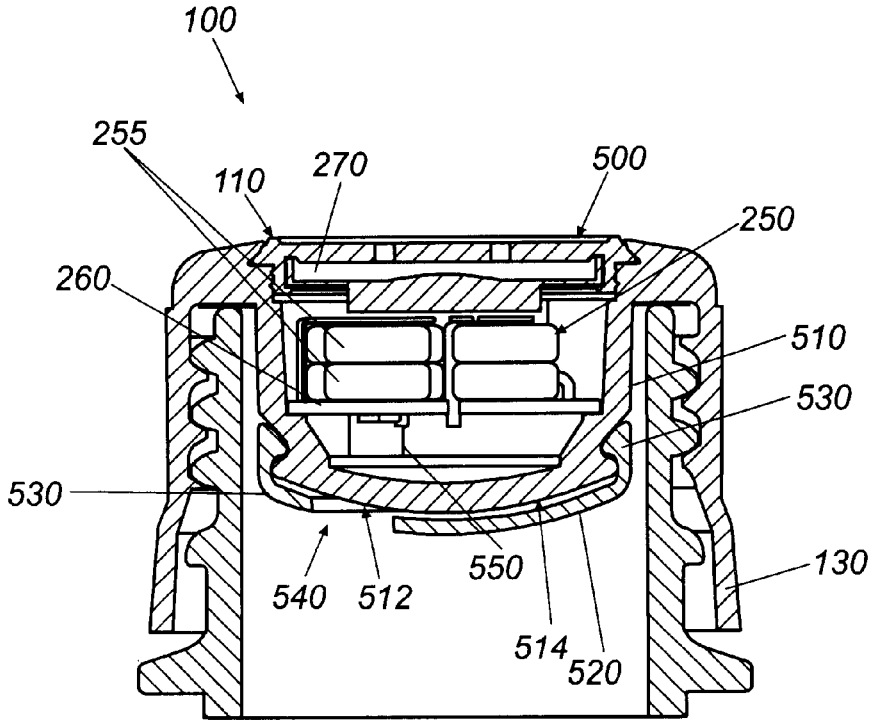
FIG. 7 is a side cross-sectional view of the rotating undercap triggering mechanism.

FIG. 7 shows a further embodiment of the triggering mechanism 110. This embodiment is a light based trigger having a rotating undercap design 500. The rotating undercap design 500 also incorporates an inner cup 510. The inner cup 510 may be formed as a unitary element with the outer cap 130. The inner cup 510 and the outer cap 130 also may be fixedly attached. The inner cup 510 may be made from a flexible thermoplastic material such as polypropylene, polyethylene, similar types of copolymers, or similar materials. The inner cup 510 may be made from the same thermoplastic material as is the outer cap 130. The inner cup 510 must permit the transmission therethrough of a certain amount of light. A first side 512 of the inner cup 510 may be more light transmissive than a second side 514. The second side 514 also may use foils or other materials to increase its opacity.

Attached to the inner cup 510 is a rotating undercap 520. The rotating undercap 520 is attached to the inner cup 520 for rotation therewith via one or more channels 530 formed in the inner cup 510. The rotating undercap 520 also may be made from a flexible thermoplastic material, such as polypropylene, polyethylene, similar types of copolymers, or similar materials. The undercap 520 preferably includes a dark, substantially light blocking color, material, or other characteristics. The rotating undercap 520 may have an aperture 540 positioned therein. The aperture 540 permits light to penetrate through the rotating undercap 520. A guide or a block of some sort may be used to limit the amount of rotation of the rotating undercap 520.

Positioned within the inner cup 510 is a light sensor 550. The light sensor may be positioned within the first side 512 of the inner cup 510. The light sensor 550 may be any type of conventional photoelectric eye-type device that can open or close the circuit 275 based upon the presence or absence of light. Any conventional type of phototransistor may be used. The light sensor 550 is in the circuit 275 with the audio device 120. The audio device 120 may have the same or similar components as those described above in FIGS. 4A or elsewhere. Specifically, the light sensor 450 may be positioned adjacent to the battery 250, the circuit board 260, and the speaker 270.

In use, the light sensor 550 is inactive when the closure 100 is in place on the bottle 200. Specifically, the aperture 540 of the undercap 520 is on the second side 514 of the inner cup 510. In this position, an insufficient amount of light penetrates through the aperture 540 and the inner cup 510 to activate the light sensor 550. As the closure 100 is removed, the undercap 520 rotates with respect to the inner cup 510. This rotation causes the aperture 540 to align with or near the light sensor 550. This alignment allows a sufficient amount of light to reach and activate the light sensor 550. Once activated, the light sensor 550 completes the circuit 275 with the battery 250, the circuit board 260, and the speaker 270. The circuit 275 causes the circuit board 260 to produce sound through the speaker 270. Alternatively, the circuit 275 may be open in the "as bottled" state, such that breaking the circuit activates the audio device 120. The reliability of the light sensor 550 depends in part upon a light extinction ratio of at least about 10,000 to 1, with about 50,000 to 1 preferred. Such a ratio should prevent the light sensor 550 from inadvertently completing the circuit 275 except when the closure 100 is being removed from the bottle 200.

Although FIGS. 1–6 show a mechanical-based triggering mechanism 110 and FIG. 7 shows an optical-based triggering mechanism 110, numerous other embodiments are possible. Other possible triggering mechanisms 110 include the use of magnetics, electronics, thermal sensors, acoustic sensors, and even chemical or environmental based devices. For example, further mechanical-based triggering mechanisms 110 may involve the use of various types of springs that expand or contract when removing the closure 100 from the bottle 200. A shape memory alloy also may be used. Likewise, various types of plungers, diaphragms, ratchets, levers, screws, clutches, or similar devices may be used such that pressure, torsion, friction, or other types of mechanical action may activate the triggering mechanism 110. The triggering mechanism 110 also may be activated directly by the user as opposed to being automatically activated by removing the closure 100. Various types of buttons, pull tabs, or ring pulls may be used for this manual activation or otherwise.

The triggering mechanism 110 also may be thermally based. For example, the heat generated by the friction caused by removing the closure 100 from the bottle 200 may be detected by the triggering mechanism 110. Likewise, the triggering mechanism 110 may detect the temperature rise from contact with the consumer's fingers in unscrewing the closure 100. Further, the triggering mechanism 110 may be activated by the Joule-Thompson effect with the escaping gas when the closure 100 is removed from the bottle 200.

The triggering mechanism 110 also may be based upon changes in the environment of the bottle 200. Pressure and humidity changes within the bottle 200 when the closure 100 is removed may activate the triggering mechanism 110. Likewise, vibrations in the beverage liquid when the bottle 200 is opened also may be detected and used to activate the audio device 120.

Various types of electronics also may be used for the triggering mechanism 110. The triggering mechanism 110 may use a wire that is placed within the liquid in the bottle 200 such that the triggering mechanism 110 is activated when the closure 100 is removed and the wire is removed from the liquid. Further, the triggering mechanism 110 may be based upon the breaking of the circuit 275 between the closure 100 and, for example, the tamper evident band. Similarly, the circuit 275 may be completed by, for example, dropping a coin into a slot in the closure 100. Other options include a radio frequency link to a component on the neck of the bottle 200 or the detection of a voltage spike from a deflected piezoelectric transducer. Even the use of triboelectrics may be possible for the triggering mechanism 110. The triggering mechanism 110 also may be remotely controlled via radio signals or similar means.

Similarly, various types of magnetics may be used based upon induction or repulsion. Various types of sensors may be used to detect the position of the closure 100 as it is removed from the bottle. For example, a magnetic proximity switch may be used. The triggering mechanism 110 also may use a magnetoresistive detector or a magnetic Reed switch.

Various types of optical or acoustic sensors also may be used for the triggering mechanism 110. For example, SONAR may be used to detect the liquid level. Further, the triggering mechanism 110 may include an acoustic sensor that would detect, for example, the sound of the temper evident band being broken or the escape of vented gas. As described above in FIG. 7, various types of photoelectric or solar cells also may be used to detect the change in light when the closure 100 is removed from the bottle 200. A pair of light emitters and detectors also may be used.

The triggering mechanism 110 also may be operated based upon a number of chemical means. For example, a mixture of chemicals caused when the closure 100 is removed from the bottle 200 could complete the circuit 275 or the mixture could generate enough output to power the audio device 120. Further, the triggering mechanism 110 could detect the changes in the level of oxygen, carbon dioxide, nitrogen, or other gases when the closure 100 is removed from the bottle 200. Any number of other alternatives for the triggering mechanism 110 may be employed in the present invention.

Figure 8A:
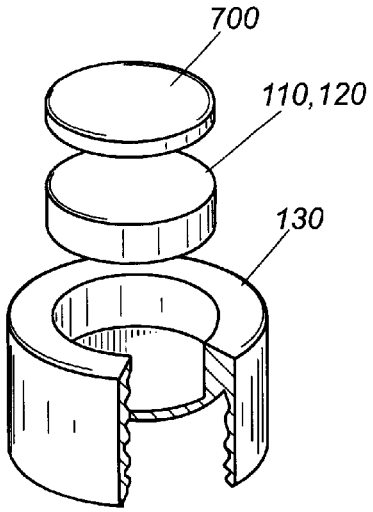
Figure 8B:
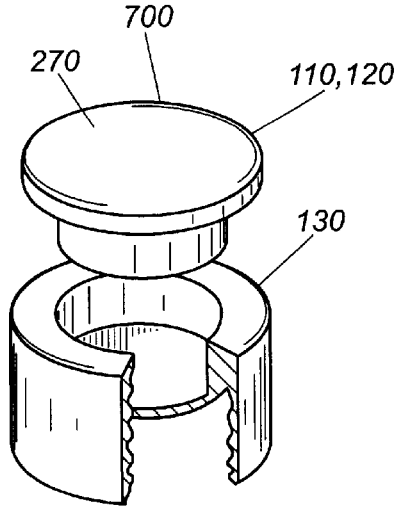
Figure 8C:
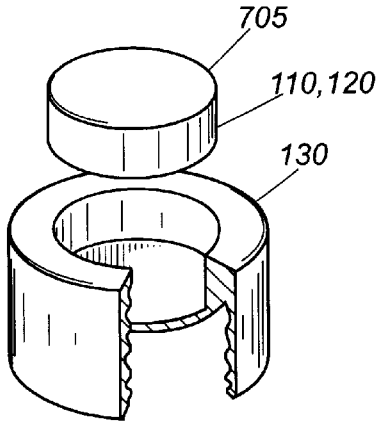

The design of the outer cap 130 and the positioning of the triggering mechanism 110 and the audio device 120 therein may take many different configurations. For example, FIGS. 8A through 8G show various positions of these elements within different designs of the outer cap 130. For example, FIGS. 8A–C show the triggering mechanism 110 and the audio device 120 positioned within an inner cup similar to that described above in FIGS. 1–7. In FIG. 8A, the triggering mechanism 110 and the audio device 120 are sealed within a membrane 700. The membrane 700 may provide structural protection to the audio device 120. The membrane 700 may be similar to the membrane 280 described above. In FIG. 8B, the membrane 700 extends across the diameter of the outer cap 130. Further, the speaker 270 also may extend in a like fashion. In FIG. 8C, the triggering mechanism 110 and the audio device 120 are sealed within a pellet-like structure 705.

Figure 8D:
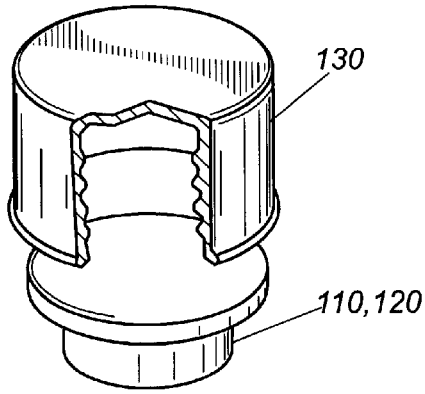
Figure 8E:
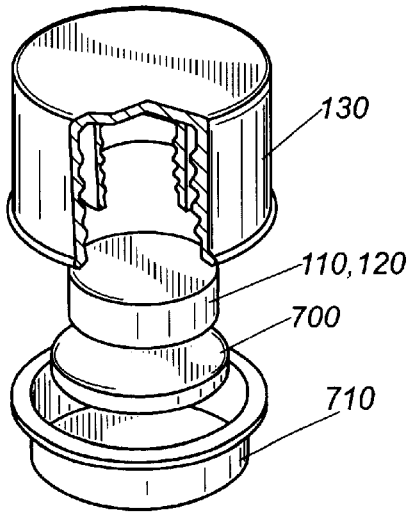

FIG. 8D shows an alternative embodiment in which the triggering mechanism 110 and the audio device 120 are positioned underneath the outer cap 130. Likewise, in FIG. 8E, the triggering mechanism 110 and the audio device 120 are positioned within a sleeve 710. FIG. 8F shows the triggering mechanism 110 and the audio device 120 positioned within a ring 720 located underneath a conventional closure. Finally, FIG. 8G shows a further alternative embodiment in which the components are positioned within a second cap 730. The use of the second cap 730 permits the use of a conventional closure. Various other configurations of the outer cap 130 and the components therein may be used. In any embodiment, the closure 100 should be attached to the bottle 200 with conventional capping equipment. Further, the closure 100 should provide closure performance equivalent to that of known closures. Because of the use of the components herein, the closure 100 of the present invention may be somewhat taller or larger than known closures.

The various components of the outer cap 130 may be joined by mechanical means such as a snap fit, a press fit, or the components may screw together. Alternatively, the components may be joined by thermal bonding such as ultrasonic, spin, or hot staking. Further, adhesives or solvents may be used. Any other type of conventional joining means also may be used.

As was described above, the battery 250 may be any type of conventional power source. The selection of the battery 250 depends in part upon the size of the battery cells 255, the type of speakers 270 used, and whether the triggering mechanism 110 requires a stand-by current. Conventional 1.5-volt alkaline, silver oxide, or zinc-air button cells 255 may be used. The cells 255 are typically 7.9 by 2.1 millimeters or 6.8 by 2.15 millimeters in size. Generally, four alkaline cells 255 may be used to provide six volts. Further, 3-volt lithium battery cells 255 also may be used. These cells 255 are usually 16 by 1.6 millimeters in size. Other conventional types of power sources also may be used. The voice chips 265 generally require about 2.5 volts at a minimum and about 6 volts at a maximum to operate. This power requirement can be accomplished by using a battery 250 with about three or four alkaline cells 255 or two lithium cells 255. The use of more cells 255 generally yields higher audio output and/or a higher number of replays.

One drawback with the use of alkaline cells 255 for the battery 250, however, is that the cells 255 generally contain an amount of mercury. Governmental regulations may prohibit or limit the use of any device that contains mercury in combination or in possible contact with a beverage. The use of lithium batteries therefore may be preferred. Lithium batteries, however, are generally more expensive on a per unit basis. Alternatively, the battery cells 255 may be sealed off from contact with or exposure to the beverage. Other types of conventional power sources also may be used.

Also as described above, the speaker 270 may be a conventional piezoelectric or an electromagnetic-type ("dynamic") speaker. The speaker 270 should be selected for sound quality, energy drain, and ruggedness. Although both types of speaker have an acceptable sound quality, an electromagnetic speaker generally has a higher current draw than a piezoelectric speaker. The speaker 270 also must be capable of submersion in water. A piezoelectric speaker generally can be submerged while an electromagnetic speaker needs to be protected by, for example, a Mylar membrane. The speaker 270 also must be resistant to the effects of the internal pressures within the bottle 200. In other words, the speaker 270 must be able to withstand or be shielded from the typical gas pressures within a sealed carbonated beverage container.

Finally, many piezoelectric speakers may contain an amount of lead. The use of such a material may conflict with certain governmental regulations as described above. Piezoelectric speakers are available without lead. For example, barium titanate piezoelectric speakers may be used. These devices, however, may be more expensive than normal piezoelectric or electromagnetic speakers. Other types of conventional sound reproducing apparatus may be used herein.

The combination of the speaker 270 and the battery 250 should provide an audio device 120 that can provide an audible message that lasts about six (6) seconds and can be heard for at least a four (4) foot radius. The battery 250 preferably can support about fifty (50) replays. The battery 250 should have a shelf life of at least about six (6) months.

Because sound quality may be impacted by the presence of water on the speaker 270, a water drain 135 may be used with the outer cap 130. Referring to FIGS. 1, 2, 9A, and 9B, the water drain 135 may include a raised structure 800 with a top surface 810 and a round side or lateral surface 820. The water drain 135 may be made from a substantially rigid thermoplastic such as polypropylene, polyethylene, PET, similar types of copolymers, or similar materials. The side surface 820 of the water drain 135 may have a plurality of apertures or grooves 830 positioned therein. The grooves 830 allow air and water to drain away from the speaker 270 and the membrane 280 thereon. The water drain 235 thus prevents water from pooling on the speaker 270 and the membrane 280 or flowing against the speaker 270 and the membrane 280 with any significant force. Specifically, the top surface 810 also prevents direct contact between the membrane 280 and a driving water source such as the warm water bath as is typically found in many bottling facilities. Further, the grooves 810 permit sound from the speaker 270 to be heard therethrough. When the bottle 200 is removed from, for example, a water bath, any angle in the removal of the bottle 200 will permit the water, if any, that may be within the water block 135 to drain through the grooves 830.

The audio device 120 in general and the speaker 270 in specific should be able to withstand submersion in about thirty (30) inches of water for at least twenty-four (24) hours. Because of the temperature difference between a hot ambient temperature and the retail ice water bath, the audio device 120 also should operate at least in a large temperature range of about thirty-two degrees (32) to about 120 degrees Fahrenheit or greater.

Referring again to FIGS. 1–4, these figures show a preferred embodiment of the present invention. In this embodiment, the closure 100 includes the double wall design 140 as the triggering mechanism 110. The audio device 120 and the triggering mechanism 110 are positioned within the outer cap 130 as described in FIG. 8B. The membrane 280 and the speaker 270 are protected from driving contact with water by the water drain 135. The speaker 270 may be electromagnetic and the battery 250 may be lithium.

If the present invention is used to announce that the consumer has won a prize of some sort, a backup indicator may be used. The backup indicator may be printed on, for example, the inside of the outer cap 130. The backup indicator may be printed directly on the outer cap 130 or a label, decal, or any conventional type of marking may be used. The backup indicator assures the consumer that the prize may be claimed even if the audio device 120 ceases to function because, for example, the batteries 250 have expired.

The present invention thus provides a closure 100 that provides an audible message when opened by the consumer. The presence of the audio device 120 can not be detected by visual inspection because the device 120 is hidden within the outer cap 130. If a similar closure 100 is used with non-winning or non-audio bottles 200, the consumer should not be able to detect the difference. The non-winning closure 100 may be weighted or contain an amount of metal such that the bottles 200 as a whole are indistinguishable. Further, the use of the outer cap 130 with the various inner cups largely protects the triggering mechanism 110 and the audio device 120 from the pressurized gases within the sealed bottle 200. The use of the sealing mechanism of, for example, FIGS. 4A and 4B also assists in the proper venting of gases. Likewise, the components herein are largely separated from the beverage itself such that there is no contact or any impact on the taste of the beverage.

Further, the present invention adequately protects the audio device 120 from the effects of submersion in water. The use of the water drain 135 and the membrane 280 adequately protects the speaker 270 from the effects of water. When the bottle 200 is removed from a water bath, the water simply drains away from the membrane 280 so as to permit adequate audio quality.

It should be apparent that the foregoing description relates only to the preferred embodiments of the present invention and that numerous changes can be made herein without departing from the spirit and scope of the invention as defined by the following claims. Specifically, the scope of the present invention is defined by the following claims rather than the foregoing description.

We claim:

1. A closure for a bottle, comprising:

an outer cap;

an audio device positioned within said outer cap;

a triggering mechanism positioned within said outer cap for activating said audio device; and a water drain positioned on said outer cap, said water drain preventing water from penetrating into said audio device.

2. The closure of claim 1, wherein said triggering mechanism activates said audio device when said outer cap is removed from said bottle.

3. The closure of claim 1, wherein said triggering mechanism activates said audio device on demand.

4. The closure of claim 1, wherein said audio device comprises a battery.

5. The closure of claim 4, wherein said battery comprises a plurality of battery cells.

6. The closure of claim 5, wherein said battery comprises alkaline, silver oxide, or zinc-air cells.

7. The closure of claim 5, wherein said battery comprises lithium cells.

8. The closure of claim 1, wherein said audio device comprises a circuit board.

9. The closure of claim 8, wherein said circuit board comprises a voice chip.

10. The closure of claim 9, wherein said voice chip comprises instructions for reproducing a language-based message.

11. The closure of claim 1, wherein said audio device comprises a speaker.

12. The closure of claim 11, wherein said speaker comprises a piezoelectric speaker.

13. The closure of claim 11, wherein said speaker comprises an electromagnetic speaker.

14. The closure of claim 11, further comprising a hydrophobic membrane covering said speaker.

15. The closure of claim 1, wherein said triggering mechanism comprises a double wall mechanism.

16. The closure of claim 15, wherein said double wall mechanism comprises a rigid cup surrounding a flexible enclosure.

17. The closure of claim 16, wherein said rigid cup comprises a substantially rigid thermoplastic such that said rigid cup resists deformation.

18. The closure of claim 17, wherein said substantially rigid thermoplastic comprises polypropylene, polyethylene, or PET.

19. The closure of claim 16, wherein said flexible enclosure comprises a flexible thermoplastic material.

20. The closure of claim 19, wherein said flexible thermoplastic material comprises polypropylene or polyethylene.

21. The closure of claim 16, wherein said flexible enclosure comprises a unitary element with said outer cap.

22. The closure of claim 16, wherein said rigid cup prevents said flexible enclosure from deforming when said outer cap is positioned on said bottle.

23. The closure of claim 22, wherein said flexible enclosure and said rigid cup separate when said outer cap is removed from said bottle such that said flexible enclosure may deform.

24. The closure of claim 23, wherein said double wall design comprises a contact switch.

25. The closure of claim 24, wherein said contact switch comprises a circuit with said audio device.

26. The closure of claim 25, wherein said contact switch comprises a plurality of arms and a platform, said plurality of arms and said platform positioned for movement therebetween.

27. The closure of claim 26, wherein said plurality of arms is positioned within said flexible enclosure for movement therewith.

28. The closure of claim 25, wherein said contact switch comprises a first position when said outer cap is positioned on said bottle.

29. The closure of claim 28, wherein said contact switch comprises a second position when said outer cap is removed from said bottle and said flexible enclosure deforms.

30. The closure of claim 29, wherein said first position of said contact switch closes said circuit.

31. The closure of claim 29, wherein said second position of said contact switch closes said circuit.

32. The closure of claim 29, wherein said triggering mechanism activates said audio device when said contact switch comprises said second position.

33. The closure of claim 1, wherein said triggering mechanism comprises a pressure ratchet mechanism.

34. The closure of claim 33, wherein said pressure ratchet mechanism comprises an inner cup.

35. The closure of claim 34, wherein said inner cup comprises a unitary element with said outer cap.

36. The closure of claim 34, wherein said inner cup comprises a flexible thermoplastic material.

37. The closure of claim 34, wherein said inner cup comprises a bottom surface, said bottom surface being deformable under pressure.

38. The closure of claim 37, wherein said inner cup comprises a pressure sensitive switch positioned adjacent to said bottom surface.

39. The closure of claim 38, wherein said pressure sensitive switch comprises a dome switch.

40. The closure of claim 38, wherein said pressure sensitive switch comprises a membrane switch.

41. The closure of claim 38, wherein said pressure sensitive switch comprises a circuit with said audio device.

42. The closure of claim 41, wherein said pressure sensitive switch comprises a first position when said outer cap is positioned on said bottle and said bottom surface is deformed under pressure.

43. The closure of claim 42, wherein said pressure sensitive switch comprises a second position when said outer cap is removed from said bottle and said bottom surface relaxes.

44. The closure of claim 43, wherein said first position of said pressure sensitive switch closes said circuit.

45. The closure of claim 43, wherein said second position of said pressure sensitive switch closes said circuit.

46. The closure of claim 43, wherein said triggering mechanism activates said audio device when said pressure sensitive switch comprises said second position.

47. The closure of claim 1, wherein said triggering mechanism comprises a push to play mechanism.

48. The closure of claim 47, wherein said push to play mechanism comprises an inner cup.

49. The closure of claim 48, wherein said inner cup comprises a unitary element with said outer cap.

50. The closure of claim 48, wherein said inner cup comprises a flexible thermoplastic material.

51. The closure of claim 48, wherein said inner cup comprises a bottom surface.

52. The closure of claim 51, wherein said inner cup comprises a contact switch positioned adjacent to said bottom surface.

53. The closure of claim 52, wherein said contact switch comprises a circuit with said audio device.

54. The closure of claim 52, wherein said triggering mechanism activates said audio device when said contact switch is pressed.

55. The closure of claim 1, wherein said triggering mechanism comprises a rotating undercap mechanism.

56. The closure of claim 55, wherein said rotating undercap mechanism comprises an inner cup.

57. The closure of claim 56, wherein said inner cup comprises a light transmissive layer.

58. The closure of claim 57, wherein said inner cup comprises a first side and a second side and wherein said first side comprises a first light transmissive level and said second side comprises a second light transmissive level.

59. The closure of claim 58, wherein said rotating undercap mechanism comprises a rotating undercap, said rotating cap attached to said inner cup for rotation therewith.

60. The closure of claim 59, wherein said rotating undercap comprises a substantially light blocking layer.

61. The closure of claim 60, wherein said rotating undercap comprises an aperture positioned therein.

62. The closure of claim 61, wherein said inner cup comprises a light sensor positioned within said first side.

63. The closure of claim 62, wherein said light sensor comprises a circuit with said audio device.

64. The closure of claim 63, wherein said light sensor comprises a first state when said outer cap is positioned on said bottle such that said aperture of said undercap is positioned on said second side of said inner cup.

65. The closure of claim 64, wherein said light sensor comprises a second state when said outer cap is removed from said bottle and said aperture of said undercap is positioned on said first side of said inner cup.

66. The closure of claim 65, wherein said first state of said light sensor closes said circuit.

67. The closure of claim 65, wherein said second state of said light sensor closes said circuit.

68. The closure of claim 65, wherein said triggering mechanism activates said audio device when said light sensor comprises said second state.

69. The closure of claim 1, wherein said triggering mechanism comprises a mechanical component.

70. The closure of claim 1, wherein said triggering mechanism comprises a thermal sensor.

71. The closure of claim 1, wherein said triggering mechanism comprises an environmental sensor.

72. The closure of claim 1, wherein said triggering mechanism comprises an electronic component.

73. The closure of claim 1, wherein said triggering mechanism comprises a magnetic component.

74. The closure of claim 1, wherein said triggering mechanism comprises an optical sensor.

75. The closure of claim 1, wherein said triggering mechanism comprises an acoustic sensor.

76. The closure of claim 1, wherein said triggering mechanism comprises a chemical sensor.

77. The closure of claim 1, wherein said outer cap comprises a first end and a second end and wherein said triggering mechanism and said audio device comprise said first end.

78. The closure of claim 1, wherein said water drain comprises a top shield positioned adjacent to said audio device.

79. The closure of claim 78, wherein said water drain comprises a lateral surface.

80. The closure of claim 79, wherein said lateral surface comprises a plurality of apertures positioned therein.

81. A closure for a bottle, comprising:

an outer cap;

an audio device positioned within said outer cap; and a double wall triggering mechanism positioned within said outer cap for activating said audio device.

82. The closure of claim 81, wherein said double wall triggering mechanism comprises a rigid cup surrounding a flexible enclosure.

83. The closure of claim 82, wherein said rigid cup comprises a substantially rigid thermoplastic such that said rigid cup resists deformation.

84. The closure of claim 83, wherein said flexible enclosure comprises a flexible thermoplastic material.

85. The closure of claim 84, wherein said double wall triggering mechanism comprises a contact switch.

86. The closure of claim 85, wherein said contact switch comprises a plurality of arms and a platform, said plurality of arms and said platform positioned for movement therebetween.

87. The closure of claim 86, wherein said plurality of arms is positioned within said flexible enclosure for movement therewith.

88. The closure of claim 85, wherein said contact switch comprises a first position when said when said outer cap is positioned on said bottle.

89. The closure of claim 88, wherein said contact switch comprises a second position when said outer cap is removed from said bottle.

90. The closure of claim 89, wherein said double wall triggering mechanism activates said audio device when said contact switch comprises said second position.

91. A closure for a bottle, comprising:

an outer cap;

an audio device positioned within said outer cap; and a pressure ratchet triggering mechanism positioned within said outer cap for activating said audio device.

92. The closure of claim 91, wherein said pressure ratchet triggering mechanism comprises a deformable inner cup.

93. The closure of claim 92, wherein said inner cup comprises a switch positioned therein.

94. The closure of claim 93, wherein said switch comprises a first position when said outer cap is positioned on said bottle and said inner cup is deformed under pressure.

95. The closure of claim 94, wherein said switch comprises a second position when said outer cap is removed from said bottle and said inner cup relaxes.

96. The closure of claim 95, wherein said pressure ratchet triggering mechanism activates said audio device when said switch comprises said second position.

97. A closure for a bottle, comprising:

an outer cap;

an audio device positioned within said outer cap; and a push button trigger positioned within said outer cap for activating said audio device.

98. The closure of claim 97, wherein said push button trigger comprises an inner cup.

99. The closure of claim 98, wherein said inner cup comprises a switch positioned therein such that said push button trigger activates said audio device when said switch is pressed.

* * * * *